US005329205A

United States Patent [19]

Goebel et al.

[11] Patent Number: 5,329,205

[45] Date of Patent: Jul. 12, 1994

[54] HIGH VOLTAGE CROSSED-FIELD PLASMA SWITCH

[75] Inventors: Dan M. Goebel, Tarzana; Robert L. Poeschel, Thousand Oaks; Ronnie M. Watkins, Agoura, all of Calif.

[73] Assignee: Hughes Aircraft Company, Los Angeles, Calif.

[21] Appl. No.: 901,353

[22] Filed: Jun. 19, 1992

[51] Int. Cl.[5] ..... H01J 7/24

[52] U.S. Cl. ..... 315/111.21; 315/111.01; 315/111.81; 315/344; 313/231.31

[58] Field of Search ..... 315/111.01, 111.81, 315/344, 111.21; 313/162, 231.31

[56] References Cited

U.S. PATENT DOCUMENTS

| | | | |
|---|---|---|---|
| 4,247,804 | 1/1981 | Harvey | 315/344 |
| 4,596,945 | 6/1986 | Schumacher et al. | 315/344 |
| 5,019,752 | 5/1991 | Schumacher | 315/344 |

FOREIGN PATENT DOCUMENTS

| | | |
|---|---|---|
| 2088123 | 6/1982 | United Kingdom . |
| 8912905 | 12/1989 | World Int. Prop. O. . |

*Primary Examiner*—Robert J. Pascal
*Assistant Examiner*—Haissa Philogene
*Attorney, Agent, or Firm*—V. D. Duraiswamy; W. K. Denson-Low

[57] ABSTRACT

A CROSSATRON switch is capable of operating with voltages in excess of 100 kV by the use of a deuterium gas fill to increase the Paschen breakdown voltage, axial molybdenum cathode corrugations to provide a higher current capability, and a Paschen shield that is formed from molybdenum. The terminal curvature of the Paschen shield and of the adjacent portion of the anode are selected to establish a voltage stress at the curved Paschen shield surface within the approximate range of 90-150 kV/cm in response to a 100 kV differential.

30 Claims, 3 Drawing Sheets

HIGH VOLTAGE CROSSED-FIELD PLASMA SWITCH

BACKGROUND OF THE INVENTION

1. Field of the Invention

This invention relates to grid-modulated plasma switches, generally referred to as CROSSATRON switches, and to the operation of such switches at voltage levels of 100 kV or greater.

2. Description of the Related Art

CROSSATRON switches are grid-modulated plasma switches capable of fast closing speeds like a thyratron, and of rapid opening like a vacuum tube. A sequence of CROSSATRON designs are shown in U.S. Pat. Nos. 4,247,804 issued Jan. 27, 1981 to Harvey, 4,596,945 issued Jun. 24, 1986 to Schumacher, macher et. al. and 5,019,752 issued May 28, 1991 to Schumacher, all of which are assigned to Hughes Aircraft Company, the assignee of the present invention.

The principals of operation of a CROSSATRON switch are illustrated in FIG. 1. The switch is a hydrogen plasma device having four coaxial, cylindrical electrodes disposed around a center axis 2. The outermost electrode 4 is the cathode, which is surrounded by an axially periodic permanent magnet stack 6 to produce a localized, cusp magnetic field 8 near the cathode surface. The innermost electrode 10 functions as an anode, while the next outer electrode 12 is a control grid and the third outer electrode 14 is a source grid.

Secondary electrons produced at the cathode surface are trapped in the magnetic field, and travel in cycloidal ExB orbits (where E is the electric field and B is the magnetic field) around the cylindrical anode 10 due to the radial electric field and the axial component of the magnetic field. The electrons eventually loose their energy via collisions, and are collected by the anode or grids. The long path length of the electrons near the cathode surface enhances ionization of the hydrogen background gas, and reduces the pressure at which the switch operates (compared to thyratrons). The hydrogen pressure in the switch can range from 100 to 700 microns, depending upon the gap spacing between the electrodes and the voltage level. The cathode material is typically molybdenum, and no cathode heater power is required.

The source grid 14 is used to minimize turn-on jitter by maintaining a low level (typically less than 20 mA) DC discharge to the cathode, while the control grid 12 is normally held within about 1kV of the cathode potential. When open, the high voltage in the switch is sustained across the gap between the control grid 12 and the anode 10. The switch is closed by pulsing the control grid to a voltage potential above that of the cathode, thereby building up the density of the plasma 16 so that it diffuses into the gap between the control grid 12 and the anode 10. The result is a low impedance conduction path between the cathode and anode, and a consequent closing of the switch. A high density plasma can be established in the switch, and the rate of current rise to the anode increased, by pre-pulsing the source grid 14 at about 1 microsecond before the closing voltage pulse is applied to the control grid 12.

Current flow through the switch is interrupted by applying a voltage pulse to the control grid 12 that is negative with respect to the potential of cathode 4. The flow of plasma from the production region near the cathode through the control grid apertures is thus blocked, and the switch opens as the plasma erodes from the anode gap. The switch opening time is determined by the plasma erosion time, which is equal to the gap spacing divided by the mean ion diffusion velocity.

The CROSSATRON switch was originally developed as a closing-only switch (U.S. Pat. No. 4,247,804), but was later advanced to a modulator switch capable of high current interruption (U.S. Pat. No. 4,596,945). In U.S. Pat. No. 5,019,752 the cathode was provided with a series of chromium-plated circular perturbations or grooves that extended around the cathode axis. The perturbations increased the effective cathode surface area exposed to the plasma, and thereby reduced the electron emission current density from the chrom surface. A reduction in the switch's forward-voltage drop was attributed to this cathode configuration.

Present CROSSATRON switches have a maximum voltage rating of 50 kV or less. Attempts to raise this voltage significantly have been unsuccessful, due to unreliable voltage standoff and periodic arcing. However, for applications such as plasma-ion implantation, plasma electron hardening, high voltage ion sources, electron guns and klystrode accelerators, the closing and opening capabilities of the CROSSATRON switch should ideally be in the 80–120 kV range. Reliable operation within this range has not been achieved with prior CROSSATRON switches.

SUMMARY OF THE INVENTION

The present invention seeks to provide an improved CROSSATRON plasma switch that is capable of reliably operating at voltage levels of 100 kV or more, and also has a high current capability and a rapid switching speed.

These goals are achieved with a novel switch structure that increases the Paschen breakdown voltage, limits the voltage stress at the high-stress portions of the Paschen shields to eliminate both vacuum and Paschen breakdown, and provides a high current handling capability.

In accordance with the invention, deuterium is used as the CROSSATRON fill gas in place of the prior use of hydrogen. Although deuterium has previously been used in thyratrons to increase the Paschen breakdown voltage compared to hydrogen at the same pressure, the use of deuterium in a CROSSATRON switch has previously been considered undesirable because of deuterium's reduced ion velocity, which significantly lowers the electron yield and the peak current capability. This drawback is resolved by providing a series of axially-directed corrugations around the cathode's interior surface. The corrugations have been found to not reduce the forward voltage drop, and yet to substantially increase the switch's current capability compared to a smooth cathode.

The high Paschen breakdown voltage achieved with the use of deuterium and an axially corrugated cathode makes possible a design for the Paschen shield that eliminates both vacuum and Paschen breakdown in this vulnerable area. The Paschen shield terminates in a curved surface, with the adjacent portion of the anode extending in a second curved surface around the end of the Paschen shield. The shapes of the opposed curved surfaces and the spacing between them are selected to establish a voltage stress at the Paschen shield's curved surface that is within the approximate range of 90–150 kV/cm, and preferably about 120 kV/cm. Properly cleaned and finished arc-cast molybdenum is used for the Paschen shield to provide a suitable voltage hold-off capability. This allows for operation in the 100 kV range or greater.

Further features and advantages of the invention will be apparent to those skilled in the art, taken together with the accompanying drawings.

DETAILED DESCRIPTION OF THE INVENTION

As a low pressure, gas-filled device, a CROSSATRON switch must have gap spacings between its high voltage electrodes that avoid both vacuum breakdown (arcing) and Paschen breakdown. However, these two breakdown mechanisms vary in opposite fashions with the gap dimension. The voltage at which vacuum breakdown occurs decreases as the gap size is reduced, so that vacuum breakdown sets the minimum gap spacings for the switch. Maximizing the gap spacings reduces the field stress and the probability of vacuum breakdown at a given voltage. For example, a prior switch implemented in accordance with U.S. Pat. No. 5,019,752 operated at 50 kV with a maximum stress of 100 kV/cm in the grid region, which requires a minimum gap spacing in the switch of 0.5 cm.

Figure 1:
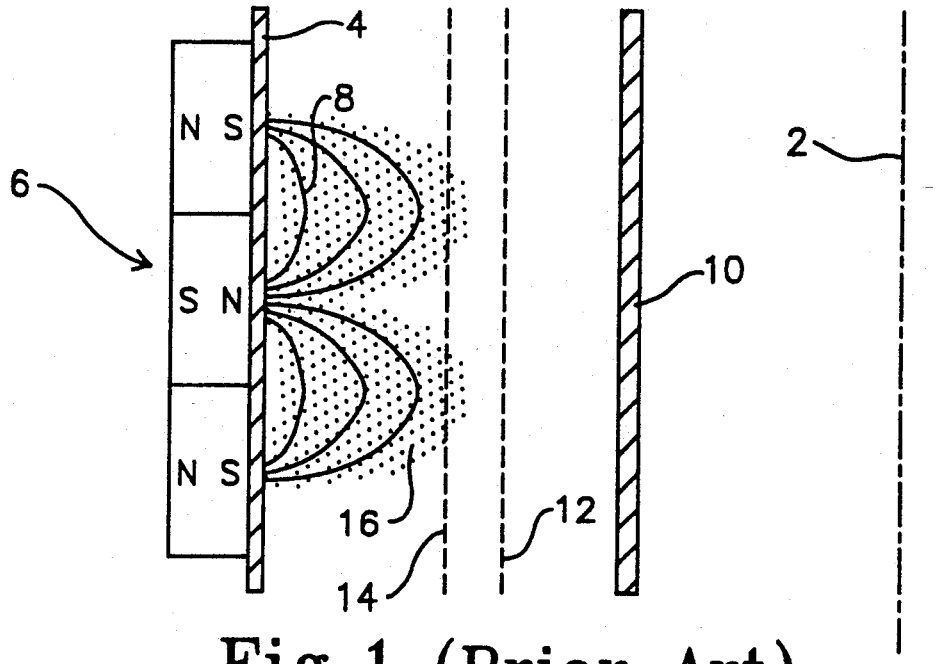
Fig.1 (Prior Art)
FIG. 1 is a diagram illustrating the operation of a prior CROSSATRON switch, described above.
Figure 2:
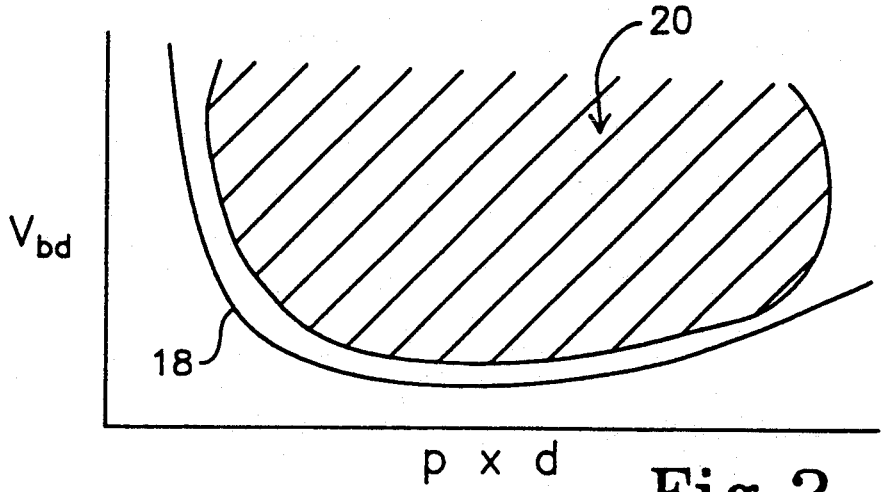
FIG. 2 is a generalized Paschen breakdown graph.

Conversely, minimizing the gap spacings reduces the likelihood of Paschen breakdown occurring at a given voltage and pressure, at least within a normal pressure-gap operating range. This effect is illustrated by the representative Paschen breakdown curve illustrated in FIG. 2, in which curve 18 plots the voltage $V_{bd}$ at which Paschen breakdown down occurs as a function of the fill pressure p times the gap distance d, in arbitrary units. For the left side of the figure, $V_{bd}$ varies in a negative fashion with the pressure-distance product, allowing breakdown to be avoided by using small gaps and low pressures to operate to the left of the curve 18. The hatched area 20 indicates the operating range at which Paschen breakdown is likely to occur.

Figure 3:
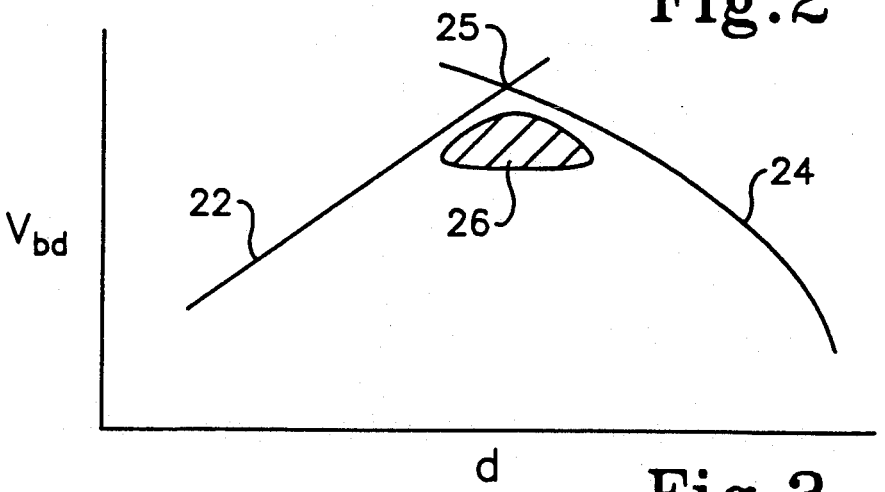
FIG. 3 is a graph illustrating vacuum and Paschen breakdown thresholds as a function of the cathode-anode distance.

The voltage threshold for vacuum breakdown varies with the gap distance in a manner opposite to the Paschen breakdown voltage; the vacuum breakdown threshold increases with the gap distance, while the Paschen breakdown threshold decreases. This is illustrated in FIG. 3, which is a generic plot of both the vacuum breakdown voltage 22 and the Paschen breakdown voltage 24 as a function of the electrode gap dimension for a fixed pressure. The vacuum breakdown curve intersects the Paschen breakdown curve at a maximum operating voltage point 25. Paschen breakdown problems are reduced by lowering the gap spacings between the anode and the grids, and between the anode and the Paschen shield. However, the gap spacing can be reduced only so far before vacuum breakdown becomes a problem. The desired operating region is indicated by shaded area 26, which lies below both the vacuum and Paschen breakdown curves, but is near their intersection 25.

With vacuum breakdown imposing a lower limit to the gap spacing, the alternative mechanism that can be used to sustain a higher voltage within the switch is to reduce the gas fill pressure. However, reducing the pressure to avoid a spontaneous breakdown can compromise the ability to generate the plasma density necessary to close the switch. In practice, a pressure of about 0.15 Torr or greater of hydrogen has been required for a CROSSATRON switch to close properly at anode currents above the grid drive current. At pressures below this level the switch either closes slowly (in greater than one microsecond), or does not fully close (a phenomenon referred to "voltage hangup" or "stalling"). The shaded region 26 in FIG. 3 defines a set of operating points at which spontaneous breakdown is avoided, but a relatively high pressure is obtained for proper closing of the switch. However, in practical devices the operating pressure is about 0.15 Torr, which is close to the value (about 0.2 Torr) at which Paschen breakdown occurs at 100 kV with hydrogen. As described above, it is desirable to increase the voltage hold-off up to about 100–120 kV; it is also desirable to increase the differential between the actual operating pressure and the Paschen breakdown pressure to provide a safety factor for normal fluctuations in pressure and voltage.

Maintaining an adequate pressure to operate the switch, while avoiding the likelihood of Paschen breakdown, is achieved by using deuterium rather than hydrogen as the fill gas for the switch. This is because the Paschen breakdown voltage is higher for deuterium than for hydrogen at the same pressure, and also because the high plasma density in the switch due to the increased ion mass and reduced ion velocity of deuterium for a given plasma generation rate provides greater electron current carrying capability. It has been shown that, for a given voltage and gap spacing, a deuterium gas fill permits a factor of two higher pressure to be tolerated in the switch compared to hydrogen before Paschen breakdown becomes a problem.

Deuterium has previously been used as a fill gas for thyratrons. However, the CROSSATRON switch has a principle of operation that is different from thyratrons and that mitigates against the use of deuterium as a fill gas. In the cold cathode discharge of CROSSATRON switches, roughly half the current is carried by the ions to the cathode. These ions strike the cathode and produce secondary electrons, which in turn ionize the fill gas and produce the plasma. The reduced ion velocity in deuterium means that, for a given generation rate, the ion current density to the cathode is reduced by roughly a factor of the square root of two. Since the electrons that ionize the fill gas in the switch come from the secondary electrons produced by ion bombardment (the secondary electron production rate for hydrogen and deuterium is roughly the same in the energy range of 400–600 volts), the lower ion current density to the cathode with deuterium results in a lower electron yield. It has been experimentally shown that the use of deuterium as opposed to hydrogen reduces the peak current capability of the switch by a factor between 1.4 and 2, and that this appears to be due primarily to the ion mass effect.

Thus, the higher fill pressure which deuterium offers over hydrogen before Paschen breakdown occurs is offset by the lower peak current capability of the deuterium cold-cathode discharge switch. This is the primary reason that has mitigated against the use of deuterium as a gas fill in CROSSATRON switches. The use of deuterium would also normally be expected to significantly reduce the switch's closing speed.

The invention includes a special cathode configuration that provides a peak closing current of up to one kiloamp (as compared with about 250 amps in hydrogen) for a deuterium-filled CROSSATRON switch operating at 100 kV. Furthermore, with this switch the use of deuterium rather than hydrogen has not been found to reduce the switch's closing speed. The cathode geometry used for this purpose is a series of relatively deep corrugations that extend axially along the cathode surface, providing both a large cathode area and a large plasma generation region in the corrugated space. A corrugated cathode design of this type has been demonstrated to have a current capability about four times high than that of a flat cathode.

In U.S. Pat. No. 5,019,752 a chrome cathode was provided with a series of annular corrugations, rather than axial corrugations as in the present invention. It was demonstrated that the corrugated chrome cathode lowered the switch's forward voltage drop by about 40% and thereby reduced the required power dissipation at high average currents. This was attributed both to the use of chrome, and to the annular corrugations. However, subsequent experiments with flat and corrugated cathodes showed no change in the forward voltage drop, so that the lower voltage drop during operation can be attributed solely to the use of chromium for the cathode.

The annular chromium corrugations in U.S. Pat. No. 5,019,752 were directed at achieving a lower voltage drop, and did not consider any increased current capability. In fact, subsequent experiments have indicated that the corrugated chrome cathode used in the patent did not greatly increase the peak current capability, primarily because the chrome corrugations exhibited frequent glow-to-arc transitions (cathode arcing) as the peak current was increased.

With the present invention, by contrast, a molybdenum cathode with axial corrugations has been found to provide substantially the same forward voltage drop as a flat cathode, but a current capability that is approximately four times higher. Relatively deep grooves are employed for the corrugations, with a depth preferably at least twice the width. The increased current capability is believed to result from an increase in the cathode surface area in contact with the plasma, which reduces the likelihood of glow-to-arc transitions in a glow-discharge plasma source; a larger volume for plasma production; and electrostatic confinement of the electrons in the corrugations that increases the ionization rate. The axially corrugated molybdenum cathode compensates for the reduction in peak current capability at lower switch pressures that would otherwise result from the use of deuterium as the fill gas, thus sustaining an adequate operating pressure without risk of Paschen breakdown. The deuterium pressure is preferably within the range of about 100–300 microns.

Figure 4:
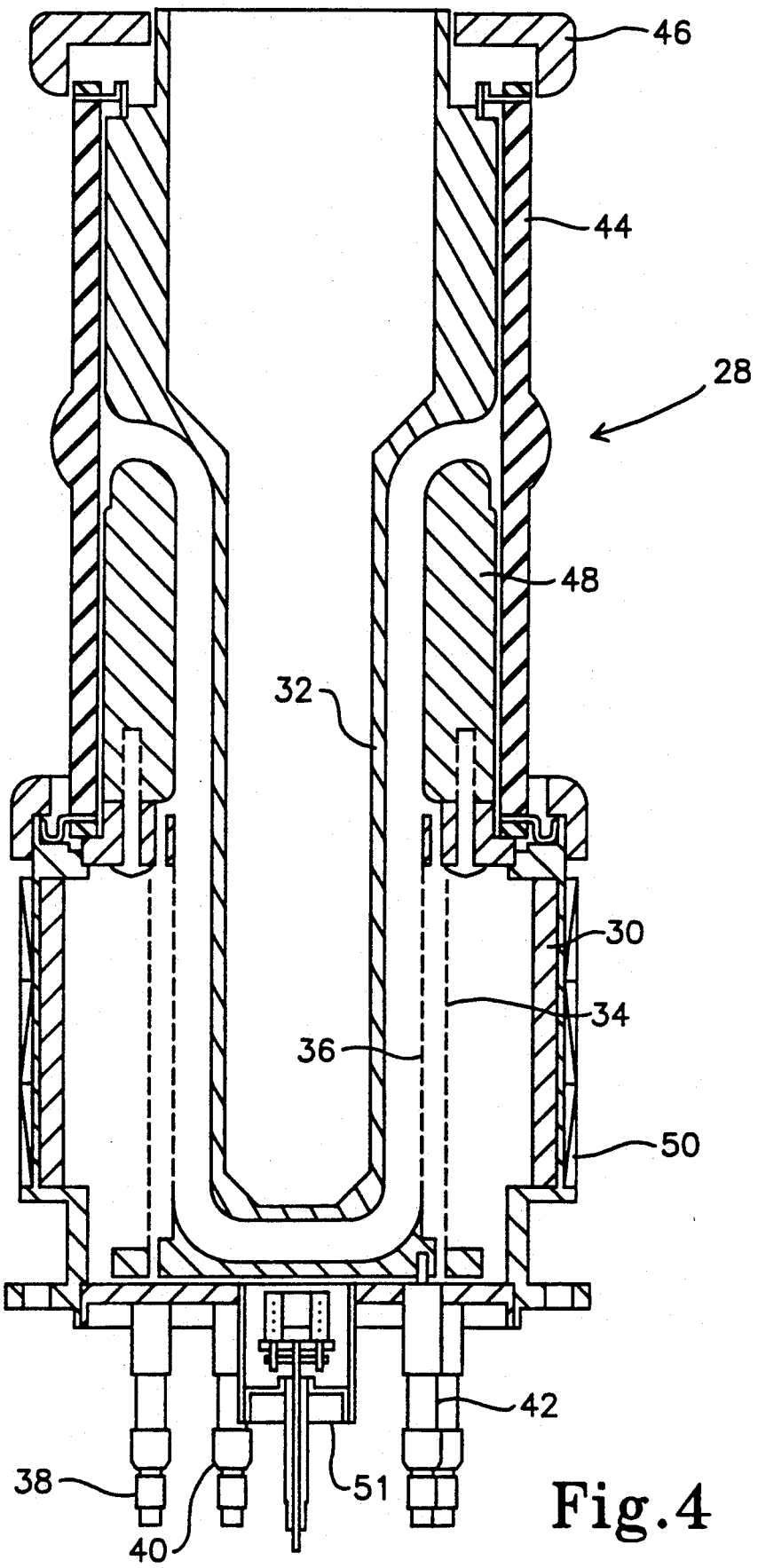
FIG. 4 is a section view of a CROSSATRON switch in accordance with the invention.

The combination of the high Paschen breakdown voltage, the deuterium fill gas, and the high current capability provided by the axially corrugated molybdenum cathode makes it possible to design a CROSSATRON plasma switch that is capable of withstanding voltages in excess of 100 kV, particularly at the Paschen shield that is normally quite vulnerable. A cross-section of a CROSSATRON switch constructed in accordance with the invention is shown in FIG. 4. A vacuum housing 28 for the switch includes a generally cylindrical cathode 30 that encircles and is radially spaced outward from an anode cylinder 32; the axial cathode corrugations will be described later in connection with FIG. 6. A source grid 34 and control grid 36 extend annularly around anode 32, inwardly from cathode 30. Electrical connectors 38, 40 and 42 are provided for the cathode, source grid and control grid, respectively. The anode 32 is mechanically suspended from a ceramic bushing 44, and is supplied with voltage signals via an electrical connector 46. An upper cathode extension 48, referred to as the "Paschen shield", surrounds the upper portion of the anode to avoid a large gap between these elements that might otherwise result in Paschen breakdown. Permanent magnets 50 are positioned on the outer cathode wall. The deuterium fill is provided from a deuterium gas reservoir 51.

The gap between the Paschen shield 48 and the anode 32 is particularly subject to voltage breakdown. The Paschen shield and adjacent portion of the anode can be designed to sustain a voltage stress (electric field) in the high stress portion of the shield that is low enough to avoid vacuum breakdown at 100 kV operation, and yet does not separate the elements so much as to enter into the region of potential Paschen breakdown. In contrast to previous CROSSATRON switches in which a molybdenum sheeting was used for the body of the cathode but stainless steel for the Paschen shield, the Paschen shield of the present invention comprises molybdenum which is a material with better Paschen breakdown characteristics than stainless steel.

Because of a lack of plasma and direct ion bombardment in the region between the Paschen shield and the adjacent portion of the anode, the voltage stress can be greater than between the anode and the control grid. For a 100 kV switch, the latter voltage stress should be within the approximate range of 70–110 kV/cm, and preferably about 100 kV/cm. In contrast, the voltage stress at the shaped upper terminal portion of the Paschen shield should be within the approximate range of 90–150 kV/cm, and preferably about 120 kV/cm.

Figure 5:
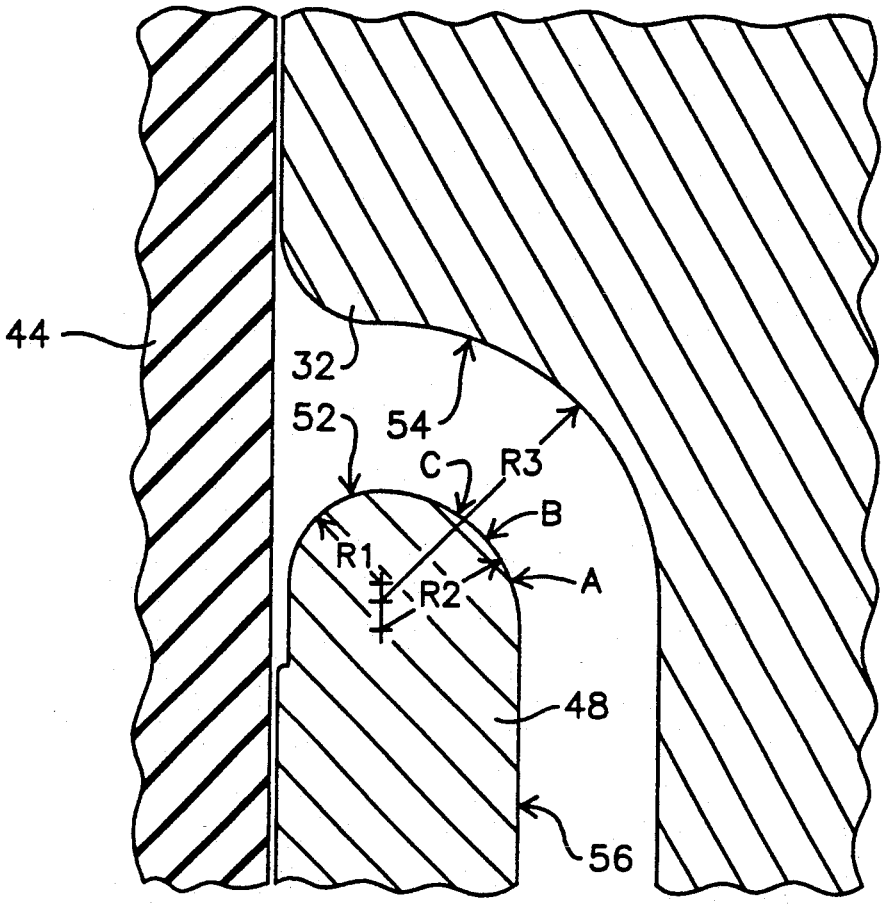
FIG. 5 is an enlarged sectional view of the Paschen shield's high stress termination and the adjacent portion of the anode.

An enlarged sectional view showing the relationship between the Paschen shield 48 and the adjacent portion of the anode 32 for a 100 kV differential is shown in FIG. 5. The upper end of the Paschen shield 48 terminates along a curved surface 52, with the adjacent anode portion describing a generally (but not exactly) concentric outer curved surface 54. The lower portion 56 of the shield is separated from the anode by a 1 cm gap, which is the same spacing between the anode and the control grid. This results in the preferred 100 kV/cm stress in this region; increasing the stress above that level in the presence of plasma increases the risk of arcing between the pulses while the switch is deionizing and high voltage ion bombardment of the control grid is occurring.

In addition to avoiding Paschen breakdown, the Paschen shield also grades the electric field strength in this area of curvature and transition to the bushing 44 and air. The shield has a compound curvature machined on its upper edge which faces the anode. The curved shield surface 52 is essentially formed by two radii that are blended together to grade the electric field enhancement due to the curvature of the equipotential lines in this region. The radius of curvature R1 for the outer portion of the upper shield surface is preferably about 0.685 cm, while the preferred radius of curvature R2 for the inside portion of the shield surface is preferably about 1.016 cm. The centers of radii R1 and R2 are vertically displaced from each other by about 0.317 cm, such that the upper edges of the two radii blend into a smooth surface facing the anode. For a 100 kV switch, the adjacent portion of the anode is preferably formed along a radius of curvature of R3 of about 2 cm, the center of which is located between the centers of R1 and R2. The curvature at the inner portion of the shield's terminal surface can also be made somewhat elliptical, to further grade the electric field strength. The maximum field strength, which occurs at point A on the shield surface, is about 121 kV/cm. Voltage stresses of about 120 kV/cm occur at points B and C, with the voltage stress diminishing on opposite sides of points A and C.

Previous CROSSATRON switches have been designed for a maximum voltage stress of less than 80 kV/cm. Designing to this value as a maximum would result in larger gap spacings at 100 kV (about 1.6 cm between the end of the Paschen shield and the anode), which would limit the pressure to less than 100 microns because of the potential for Paschen breakdown. This, however, is too low a pressure for proper operation of the switch. The present invention makes possible the higher electrode stress levels that are necessary for a CROSSATRON switch to operate properly at 100 kV or greater.

With these high voltage stress levels, it is important that properly cleaned molybdenum be used for the Paschen shield. It is preferably formed from arc-cast molybdenum which has at least a 0.4 micron finish and has been cleaned by electro-polishing. The electro-polish should not leave any residue or surface impurities. A Paschen shield formed in this manner had a voltage hold-off capability about one-third greater than press-sintered molybdenum and stainless steel elements. The selection of materials for the anode is not as critical, and molybdenum, tungsten, tantalum or other refractive metals could be used; titanium is not recommended because it forms a hydride with deuterium that absorbs the gas, becomes brittle and crumbles.

Figure 6:
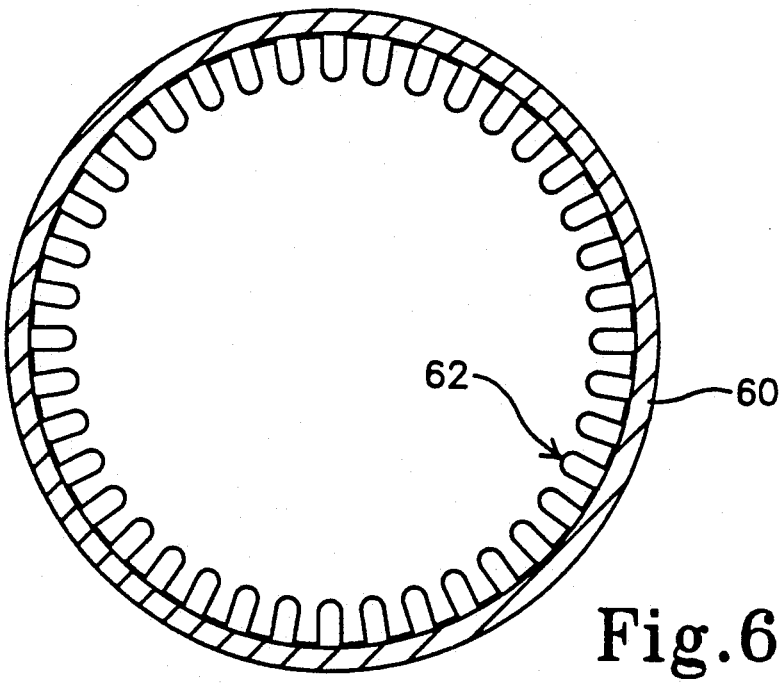
FIG. 6 is a sectional view of the preferred cathode configuration for the invention.

A sectional view of the main portion of the cathode is shown in FIG. 6. It preferably consists of a hollow stainless steel cylinder 60 that provides a support structure for an inner molybdenum sheet 62, with the sheet folded into a corrugated structure. The corrugations are relatively deep to provide both a large cathode area and a large plasma generation region in the corrugated space. The depth of each corrugation is preferably at least twice its width; corrugations 3 mm wide by 6 mm deep were employed in a demonstration of the invention. The corrugated molybdenum sheet 62 can be spot welded or brased onto the cathode body 60; it is quite inexpensive to fabricate and easy to install.

With the CROSSATRON switch described above, operation has been demonstrated at an open-circuit voltage of 100 kV, with closing and opening currents of 1 kA and switching times of less than one microsecond, at a deuterium pressure of about 0.2 Torr.

While a preferred illustrative embodiment has been shown and described, numerous variations and alternate embodiments will occur to those skilled in the art. Such variations and alternate embodiments are contemplated, and can be made without departing from the spirit and scope of the invention as defined in the appended claims.

We claim:

1. A plasma switch, comprising:

a vacuum housing, a generally cylindrical cold cathode within said housing providing a source of secondary electrons, said cathode including a plurality of generally axially-directed corrugations around its interior surface, a generally cylindrical anode disposed inwardly of the cathode and extending axially beyond the limit of said cathode, a generally cylindrical source grid disposed between said anode and cathode, means for introducing an ionizable gas into the space between the cathode and source grid, said cathode and source grid maintaining a plasma therebetween in response to a predetermined voltage differential between them, a generally cylindrical control gird disposed between said source grid and anode for selectively enabling and terminating a plasma path between the cathode and anode, and thereby closing and opening the switch, in response to control voltage signals applied to the control grid, a magnet means configuring the plasma to a predetermined area between the cathode and anode, said magnet means producing a magnetic field that traps secondary electrons from the cathode and, together with a radial electric field, causes said electrons to travel in cycloidal orbits, and a generally cylindrical Paschen shield extending from said cathode adjacent to but spaced from a portion of said anode which extends beyond said cathode, said Paschen shield terminating in a first curved surface, the extended portion of said anode describing a second curved surface that is approximately concentric with and spaced from said first curved surface, the shapes of said curved surfaces and the spacing between then being selected to establish a voltage stress at said first curved surface within the approximate range of 90–150 kV/cm in response to a 100 kV differential between said anode and Paschen shield.

2. The plasma switch of claim 1, wherein said Paschen shield is formed from molybdenum.

3. The plasma switch of claim 2, wherein said Paschen shield is formed from electro-polished, arc-cast molybdenum having at least a 0.4 micron finish.

4. The plasma switch of claim 1, wherein the shapes of said curved surfaces and the spacing between them are selected to establish a voltage stress at said first curved surface of approximately 120 kV/cm.

5. The plasma switch of claim 1, wherein the spacing between said cathode and anode is selected to establish a voltage stress between them within the approximate range of 70–110 kV/cm in response to a 100 kV differential.

6. The plasma switch of claim 5, wherein the spacing between said anode and cathode is selected to establish a voltage stress between them of approximately 100 kV/cm.

7. The plasma switch of claim 1, wherein said ionizable gas comprises deuterium.

8. The plasma switch of claim 7, said generally cylindrical cathode including a plurality of generally axially-directed corrugations around its interior surface.

9. The plasma switch of claim 7, wherein said Paschen shield is formed from molybdenum.

10. The plasma switch of claim 1, wherein the depths of said corrugations are at least approximately twice their widths.

11. The plasma switch of claim 1, said corrugations being formed from molybdenum.

12. The plasma switch of claim 11, said cathode comprising a conductive and generally cylindrical hollow base member with a corrugated molybdenum sheet affixed to its inner surface.

13. The plasma switch of claim 1, wherein said ionizable gas comprises deuterium.

14. The plasma switch of claim 13, wherein said Paschen shield is formed from molybdenum.

15. A plasma switch, comprising:

a vacuum housing, a cold cathode within said housing providing a source of secondary electrons, an anode spaced from said cathode and extending beyond the limit of said cathode, a source grid disposed between the anode and cathode within the housing, means for introducing an ionizable ga into the space between the cathode and source grid, said cathode and source grid maintaining a plasma therebetween in response to a predetermined voltage differential between, them, a control grid disposed between said source grid and anode for selectively enabling and terminating a plasma path between the cathode and anode, and thereby closing and opening the switch, in response to control voltage signals applied to the control grid, a magnet means confining the plasma to a predetermined area between the cathode and anode, and a Paschen shield extending from said cathode adjacent to but spaced from a portion of said anode which extends beyond said cathode, said Paschen shield being formed from molybdenum, said Paschen shield terminating in a first curved surface, the extended portion of said anode describing a second curved surface that is approximately concentric with and spaced from said first curved surface.

16. The plasma switch of claim 15, wherein said ionizable gas comprises deuterium.

17. The plasma switch of claim 15, said cathode being generally cylindrical and including a plurality of generally axially-directed corrugations around its interior surface.

18. The plasma switch of claim 17, wherein the depths of said corrugations are at least approximately twice their widths.

19. The plasma switch of claim 17, said cathode comprising a conductive and generally cylindrical hollow base member with a corrugated molybdenum sheet affixed to its inner surface.

20. The plasma switch of claim 17, wherein said ionizable gas comprises deuterium.

21. A plasma switch, comprising:

a vacuum housing, a generally cylindrical cold cathode within said housing providing a source of secondary electrons, said cathode including a plurality of generally axially-directed corrugations around its interior surface, a generally cylindrical anode disposed inwardly of said cathode, a generally cylindrical source grid disposed between the anode and cathode within the housing, means for introducing an ionizable gas into the space between the cathode and source grid, said cathode and source grid maintaining a plasma therebetween in response to a predetermined voltage differential between them, a generally cylindrical control grid disposed between said source grid and anode for selectively enabling and terminating a plasma path between the cathode and anode, and thereby closing and opening the switch, in response to control voltage signals applied to the control grid, and a magnet means confining the plasma to a predetermined area between the cathode and anode, said magnet means producing a magnetic field that traps secondary electrons from the cathode and, together with a radial electric field, causes said electrons to travel in cycloidal orbits, said axially corrugated cathode having a greater current density capability than a cathode of similar diameter but with a smooth electron emitting surface.

22. The plasma switch of claim 21, wherein the depths of said corrugations are at least approximately twice their widths.

23. The plasma switch of claim 21, said cathode comprising a conductive and generally cylindrical hollow base member with a corrugated molybdenum sheet affixed to its inner surface.

24. The plasma switch of claim 1, wherein said first Paschen shield surface describes a compound curvature with inner and outer curves that have respective radii of curvature, the radius of curvature for the inner curve being longer than the radius of curvature for the outer curve.

25. The plasma switch of claim 24, wherein the radii of curvature for said inner and outer curves have respective origins located within said Paschen shield, with the origin for the inner curve radius generally axially displaced from the origin for the outer curve radius in a direction towards said cold cathode.

26. The plasma switch of claim 25, wherein said second curved surface described by the anode has a radius of curvature with an origin located between the radius of curvature origins for said inner and outer Paschen shield curves.

27. The plasma switch of claim 15, wherein said first Paschen shield surface describes a compound curvature with inner and outer curves that have respective radii of curvature, the radius of curvature for the inner curve being longer than the radius of curvature for the outer curve.

28. The plasma switch of claim 27, wherein the radii of curvature for said inner and outer curves have respective origins located within said Paschen shield, with the origin for the inner curve radius generally axially displaced from the origin for the outer curve radius in a direction towards said cold cathode.

29. The plasma switch of claim 28, wherein said second curved surface described by the anode has a radius of curvature with an origin located between the radius of curvature origins for said inner and outer Paschen shield curves.

30. The plasma switch of claim 21, wherein said ionizable gas comprises deuterium.

* * * * *

UNITED STATES PATENT AND TRADEMARK OFFICE

CERTIFICATE OF CORRECTION

PATENT NO. : 5,329,205

DATED : July 12, 1994

INVENTOR(S) : D. M. GOEBEL ET AL

It is certified that error appears in the above-identified patent and that said Letters Patent is hereby corrected as shown below:

Column 8:

Claim 1, line 23, delete "configuring" and insert instead --confining--; and line 37, delete "then" and insert instead --them--.

Column 9:

Claim 15, line 9, delete "ga" and insert instead --gas--; and line 13, after "between" delete ", (a comma)."

Signed and Sealed this

Twelfth Day of September, 1995

*Attest:*

*Attesting Officer*

BRUCE LEHMAN

*Commissioner of Patents and Trademarks*